US008643448B2

(12) United States Patent
Kane et al.

(10) Patent No.: US 8,643,448 B2
(45) Date of Patent: Feb. 4, 2014

(54) HIGH POWER MINIATURE RF DIRECTIONAL COUPLER

(75) Inventors: David V. Kane, Dunbarton, NH (US); Mark A. Stanley, Francestown, NH (US); Kevin Devine, Manchester, NH (US)

(73) Assignee: Technical Research and Manufacturing, Inc., Bedford, NH (US)

( * ) Notice: Subject to any disclaimer, the term of this patent is extended or adjusted under 35 U.S.C. 154(b) by 244 days.

(21) Appl. No.: 13/248,336

(22) Filed: Sep. 29, 2011

(65) Prior Publication Data

US 2012/0081191 A1 Apr. 5, 2012

Related U.S. Application Data

(60) Provisional application No. 61/388,817, filed on Oct. 1, 2010.

(51) Int. Cl.
*H01P 5/12* (2006.01)
*H01P 3/08* (2006.01)

(52) U.S. Cl.
USPC ..... 333/116; 333/109

(58) Field of Classification Search
USPC ..... 333/109, 110, 111, 112, 115, 116, 238
See application file for complete search history.

(56) References Cited

U.S. PATENT DOCUMENTS 3,560,893 A * 2/1971 Wen ..... 333/24.1
4,607,240 A * 8/1986 Isota et al. ..... 333/116
4,967,171 A * 10/1990 Ban et al. ..... 333/116
5,235,295 A * 8/1993 Barbaste et al. ..... 333/28 R

* cited by examiner

*Primary Examiner* — Dean O Takaoka
(74) *Attorney, Agent, or Firm* — Bourque and Associates, PA

(57) ABSTRACT

An RF directional coupler fabricated utilizing a printed circuit structure that includes a plated slot or trough as and electrical conduit. The slot intersects a capture pad at the end of the trace. The plating wraps around to this capture pad making the trough a hollow trace. The hollow trace allows a large surface area to be parallel in the same plane. The smooth surface of the routed slot allows for a smooth copper surface unlike a typical wall of a hole or treated copper. These unique vertical edge plated troughs inside the coupler providing two significant advantages over previous coupling techniques. First, the surface area of the lines is greater which greatly increases its power handling capability. Second, the mainline and coupled lines all lie in the same plane simplifying construction of the coupler into a pick and place circuit.

14 Claims, 3 Drawing Sheets

HIGH POWER MINIATURE RF DIRECTIONAL COUPLER

CROSS-REFERENCE TO RELATED APPLICATIONS

This application claims priority from U.S. Provisional Patent Application No. 61/388,817 filed on Oct. 10, 2011 titled "High Power Miniature RF Directional Coupler", which is incorporated fully herein by reference.

TECHNICAL FIELD

The present invention relates to an electrically short directional coupler that can operate over an extremely wide frequency range at high power levels and more particularly, relates to a coupler that is in a very small package suitable for assembly with pick and place robotic automation. The coupler is entirely fabricated with printed circuit technology but incorporates a unique coupling structure.

BACKGROUND INFORMATION

Current couplers are typically fabricated with edge coupled or broadside coupled printed striplines. The edge coupled technology cannot achieve the same coupling levels as the minicoupler unless it is made longer (bigger). The broadside coupled lines can achieve the coupling level but they cannot handle as much power as the minicoupler. The broadside coupled lines also require the lines to lie in three separate planes increasing the complexity of the device.

Additionally, current directional couplers which utilize coupled lines which are ¼ wave long or multi-section lines which are multiples of ¼ wavelength, are physically large compared to the mini-coupler of the present invention and generally are not capable of automatic insertion with pick and place equipment.

SUMMARY

The present invention achieves coupling by utilizing a unique printed circuit structure. This unique structure uses a plated slot or "trough" as an electrical trace or line. The trough intersects or electrically is coupled to two capture pads at the ends of each trough. The trough allows large surface area to be parallel and in the same plane. The smooth surface of the routed slot allows for a smooth copper surface unlike a typical hole wall or treated copper. This invention utilizes these unique vertical edge plated troughs inside the coupler. This has two significant advantages over previous coupling techniques. First, the surface area of the lines is greater which greatly increases its power handling capability. Second, the mainline and coupled lines all lie in the same plane simplifying construction of the coupler.

It is important to note that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
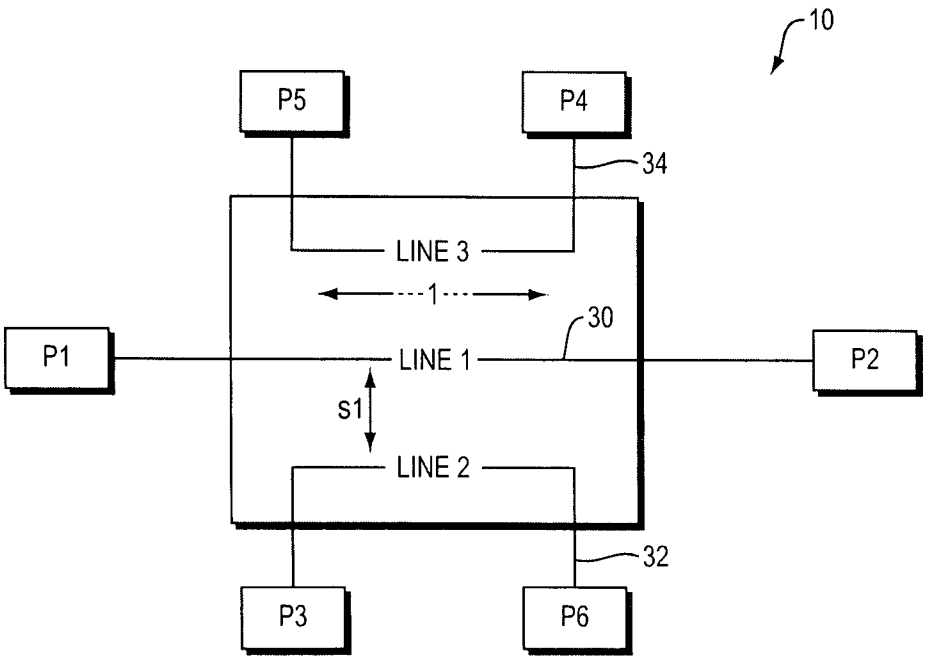
FIG. 1 is schematic plan view of the mini-coupler of the present invention.

The present invention, referred to herein as a mini-coupler 10, FIG. 1, is preferably a 6 (six) port device which has the characteristics of a dual, directional coupler (although a 4 (four) port device which serves as a single directional coupler is contemplated by the present invention). High Power Directional couplers are used in many ways. The most common application is monitoring the power levels of a high power device with equipment or circuits designed for low power. The Directional Coupler samples a small, known fraction of the high power line. The directional coupler can also separately sample waves of energy flowing in opposite directions (usually referred to as forward and reverse or reflected waves). The primary energy flowing through the main line (1) 30 is loosely coupled to the coupled line (2) 32 and, if provided, coupled line (3) 34 through a combination of magnetic and electrostatic coupling, as will be explained in greater detail below. This coupling mechanism gives the coupler its directional characteristics.

The basic coupling mechanism is well known and has been used extensively for many years. When P5 and P6 are terminated in the characteristic impedance, typically 50 ohms, P3 will couple energy entering at P1 and reject energy entering at P2. Similarly, P4 will couple energy from P2 and reject energy from P1. P5 and P6 must be terminated in the characteristic impedance of the system.

The amount of energy from line (1) 30 coupled to the coupled lines (2) 32 and/or (3) 34 is a function of the length of the line (l) 30 and the proximity (s1) of the coupled lines (2) 32 and/or (3) 34 to the mainline. Length and spacing are the principle factors for a given physical size of the lines. Changing the size of the lines will affect the amount of energy transferred but the dimensions of the troughs determine the characteristic impedance of the coupler, normally desired to be 50 ohms. Accordingly the characteristics of the troughs including size, length, depth and spacing cannot be arbitrarily changed to alter the coupled energy. For a given frequency fo in the mail line 1 (30), and spacing s1, the maximum coupling is achieved when the electrical length (l) of coupled line (2) or (3) is equal to ¼ wavelength of fo. For frequencies below fo, the coupling decreases. The ratio of the input power to the coupled power approaches a logarithmically linear slope of 6 db per octave. An attenuation equalizer or leveling module as described below with an inverse slope can be added to the coupled line to produce a flat coupled response over a broad band of frequencies.

Figure 2A:
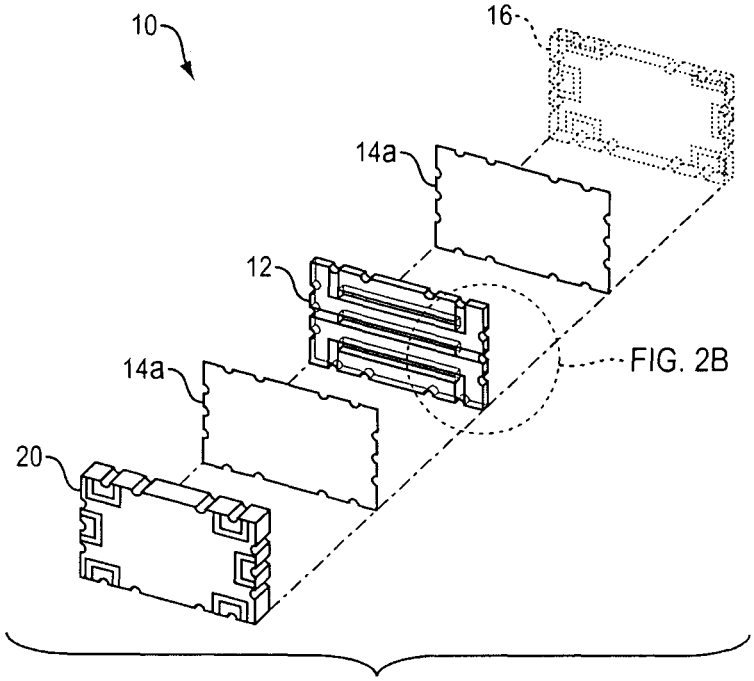
FIGS. 2A and 2B are exploded and partial views respectively of the mini-coupler of the present invention.
Figure 2B:
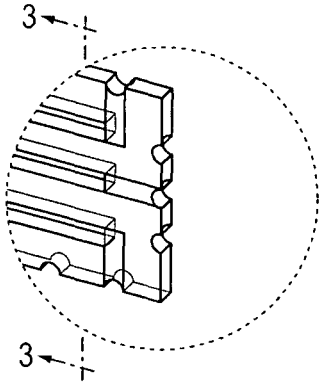
Figure 3:
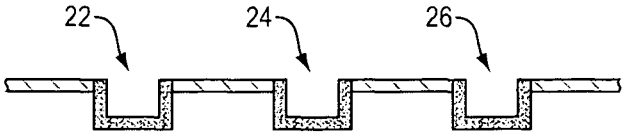
FIG. 3 is a cross-sectional view taken along lines 3-3 in FIG. 2B.

The mini-coupler 10 according to the present invention is shown in an exploded view in FIG. 2A. The mini coupler 10 is fashioned on a standard printed circuit board substrate 12 utilizing standard, well known printed circuit board manufacturing and plating techniques. The substrate 12 containing the mini coupler circuit of the present invention may be sandwiched between one or more bonding layers 14 (which are thin 0.002 to 0.005 inch thick adhesive layers that serve to bond or adhere the substrate layer 12 to the top and bottom layers 20 and 16) and assembled between a base carrier substrate 16 and a top carrier substrate 20. Each of the top and bottom carrier substrates 20, 16 serve to form part of the electrical signal characteristics of the troughs and provide a ground plane for the mini-coupler 10. Each of the substrate layers 12, 16 and 20 are approximately 0.060 inches thick. As shown in FIG. 2B and FIG. 3, a key feature of the present invention which allows the miniaturization of the coupler is the use of electrically plated "troughs" 22, 24 and 26 as part of each of the "lines" 1, 2 and 3 (30, 32, and 34) in place of simple, traditional essentially only two-dimensional thin, surface plated copper lines used in the prior art couplers which allow for only very limited power to travel through such lines. The use of the electrically plated "troughs" as disclosed herein in connection with the present invention allows the coupler of the present invention to carry significantly more power in a significantly smaller package and further allows the coupler to be tailored to the desired power and coupling configuration.

In the preferred embodiment, each of the "troughs" are approximately 0.035 inches wide by approximately 0.030 inches high and have a length of approximately 0.4 inches, although this is not a limitation of the present invention as other sizes and dimensions are within the scope of the present invention and the skill of those in the art. The spacing between each trough is approximately 0.030 inches although this is not a limitation of the invention. Each "trough" is plated in copper (although other conductive materials may be used) approximately (0.001) inches in thickness (although other thicknesses are contemplated). The present invention achieves significant advantage in coupling by utilizing vertical edge plated troughs inside the coupler. Utilizing this technique means that the surface area of the lines is greater, which greatly increases their power handling capability while secondly, both the main line 30 and the coupled lines 32, 34 all lie in the same plane significantly simplifying construction. Although each trough is shown in the form of a square shape, this is not a limitation of the present invention as other forms and shapes (triangular, rectangular, octagon, circular, oblong etc) and sizes of "troughs" are contemplated by the present invention and within the scope of the present disclosure.

Other forms of the mini-coupler according to the present invention can be made to increase the power handling by using different substrates. The presently envisioned substrate is a basic, traditional glass-epoxy commonly known as FR-4, which is low cost and machines well. Other substrates contemplated by the present invention are mixtures of Teflon, ceramic and fiberglass (in any varying combination) such as Duroid™ which are more expensive, do not machine as easily but have lower loss and higher power handling characteristics.

There are many commercial applications for the device. Because of its small size and relatively low manufacturing cost, it can be used in high volume manufacturing of radio equipment such as transmitters, transceivers, and jammers.

Leveling Module for the Mini-Coupler

This invention may also include a device (the mini-coupler 10) capable of insertion into automated high volume manufacturing pick and place equipment, in which the coupled line response of the mini-coupler is attenuated to achieve a flat response with respect to frequency. If the mini-coupler is not also connected to a leveling or filtering circuit, the energy coupled by each of the troughs 22, 26 increases as the frequency of the signal increases. Accordingly, what is needed is a leveling circuit for use with the mini-coupler. The leveling circuit may be physically located on another circuit (a leveling module or chip) and electrically coupled to the mini-coupler 10 or more preferably, the circuit and its components may be located directed on the substrate 12 of the mini-coupler 10.

Figure 4:
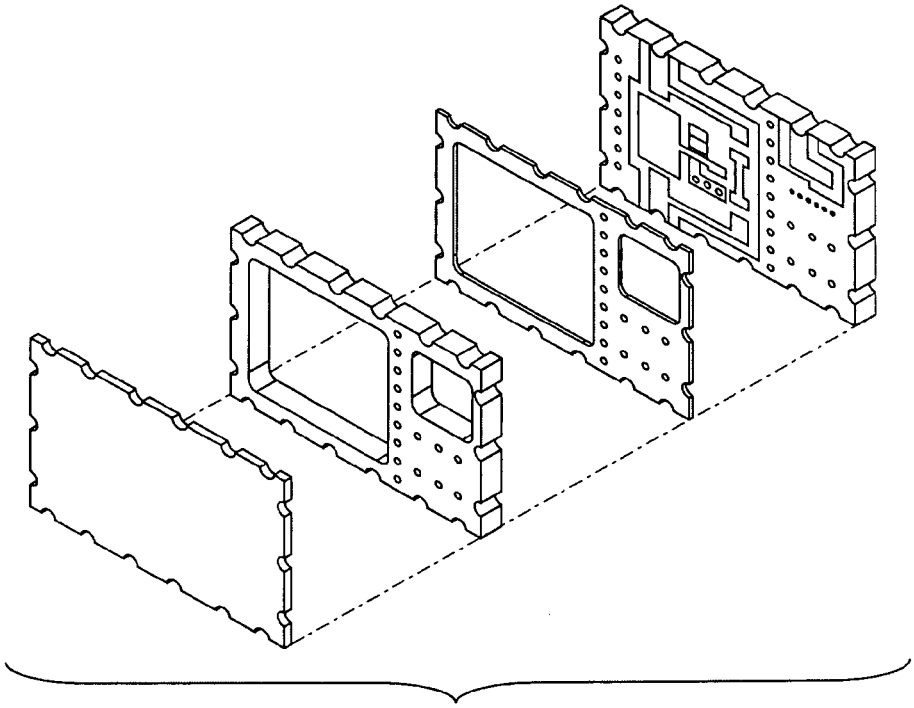
FIG. 4 is an exploded view of the mini-coupler assembly of the present invention.

The circuit of the leveling module is essentially an absorptive filter circuit in which the signal attenuation follows a logarithmically liner slope which is inverse to the coupled output of the mini-coupler. The absorptive quality of the filter maintains the impedance match of both the input and output ports of the device. Such circuits (of which there are many designs) are well known in the art and one example of such a circuit is shown schematically in FIG. 4.

Additionally, different filter arrangements of the leveling circuit can be employed which optimize the coupled response over various sub-bands of the mini-coupler response. For example, one filter may cover a span of 20-1000 MHz at a coupling value of −53 db. Another filter can be made cover a band of 100-500 MHz at a coupling value of −40 db. Yet another can cover a band of 200-1000 MHz at −30 db coupling. A different filter would be used and tuned or designed for each frequency range.

Figure 5:
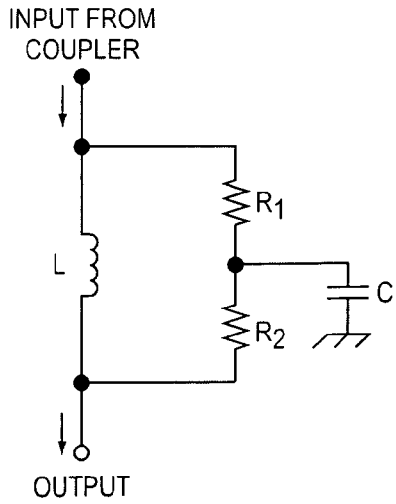
FIG. 5 is a schematic diagram of a sample leveling module circuit that may be utilized in connection with the present invention.

As shown in FIG. 5, the values of the various leveling circuit components such as the inductor L, the resistors R1 and R2 and the capacitor C can be selected, as is well known by someone skilled in the art, to provide the desired filter band range. The filter is part of the leveling module that is electrically coupled to the mini-coupler 10 so that, for example, if customer A wanted a 20-1000 MHz coupler, they would get the minicoupler with a 20-1000 MHz leveling module, while Customer B wanting a 100-500 MHz coupler would get the same minicoupler but a different leveling module or circuit covering a frequency range of 100-500 Mhz.

The device package of a leveling module may be constructed using multi-layer printed circuit technology. The leveling circuitry consists of lumped element absorptive filters. Previously, various types of filters circuits have been used in this type of coupler but they are typically incorporated into an enclosed housing along with RF Connectors which makes them large and unsuitable for high volume manufacture techniques. The leveling module of the present invention is designed to be provided either directly on the same substrate of the mini-coupler or in connection with the mini-coupler 10 of the invention as a pick and place circuit or "chip" that can be provided on a reel and fed to a component pick and place machine for automated assembly and ultimate electrical connection as desired.

Modifications and substitutions by one of ordinary skill in the art are considered to be within the scope of the present invention, which is not to be limited except by the allowed claims and their legal equivalents.

The invention claimed is:

1. An RF directional coupler comprising:

a printed circuit board substrate configured to contain at least an RF coupler circuit and including a top surface and a bottom surface, said printed circuit board substrate including:

a first, electrically conductive line, said first electrically conductive line including an input and an output, and configured for carrying a main signal whose energy is desired to be monitored;

at least a second electrically conductive line, said at least a second electrically conductive line including an input and an output, said at least a second electrically conductive line disposed a predetermined distance away from said first, electrically conductive line on said printed circuit boards substrate and configured for electrically coupling at least a portion of said energy from said first, electrically conductive line; and wherein each of said first and at least a second electrically conductive lines are configured as electrically plated troughs having a predetermined width and a predetermined height;

a base carrier substrate, configured to attach to said bottom surface of said printed circuit board substrate; and a top carrier substrate, configured to attach to said upper surface of the printed circuit board substrate.

2. The RF directional coupler of claim 1, further including a leveling module, electrically coupled to said input and output of said at least a second line, and configured as an absorptive filter circuit in which a signal attenuation and said at least a second line follows a logarithmically linear slope which is inverse to a coupled output of the mini coupler.

3. The RF directional coupler of claim 1, wherein said printed circuit board substrate further includes a third, electrically conductive line, said at least a third electrically conductive line including an input and an output, said at least a third electrically conductive line disposed a predetermined distance away from said first, electrically conductive line on said printed circuit boards substrate and configured for electrically coupling at least a portion of said energy from said first, electrically conductive line; and wherein each of said first, second and third electrically conductive lines are configured as electrically plated troughs having a predetermined width and a predetermined height.

4. The RF directional coupler of claim 3, wherein said printed circuit board substrate further includes at least one leveling circuit, electrically coupled to said input and output of said at least a second and third electrically conductive lines, and configured as an absorptive filter circuit in which a signal attenuation and said at least a second and third electrically conductive lines follows a logarithmically linear slope which is inverse to a coupled output of the mini coupler.

5. The RF directional coupler of claim 1, wherein the one or more bonding layers are 0.002 to 0.005 inches thick and are configured to bond the substrate layer to the top and bottom layers.

6. The RF directional coupler of claim 1, wherein the printed circuit board substrate, the base carrier substrate and the top carrier substrate are each approximately 0.060 inches thick.

7. The RF directional coupler of claim 1, wherein the printed circuit board substrate includes a plurality of leveling circuits, wherein each of said plurality of leveling circuits is configured to respond to a different frequency.

8. The RF directional coupler of claim 1, wherein each of said troughs are approximately 0.035 inches wide by approximately 0.03 inches high and have a length of approximately 0.4 inches.

9. The RF directional coupler of claim 1, wherein a spacing between each of said troughs is approximately 0.030 inches.

10. The RF directional coupler of claim 1, wherein said of said troughs is plated in copper approximately 0.001 inches in thickness.

11. The RF directional coupler of claim 1, wherein the printed circuit board substrate is constructed from a glass-epoxy material, such as FR-4.

12. The RF directional coupler of claim 1, wherein the printed circuit board substrate is constructed from a mixture of Teflon, Ceramic, and fiberglass in any combination.

13. The RF directional coupler of claim 1, wherein said leveling module further includes a filter, wherein said filter and leveling module are electrically coupled to said RF directional coupler, and wherein said filter features a span and a coupling value that is configured for a particular frequency range.

14. The RF directional coupler of claim 1, wherein said leveling module is constructed using multi-layer printed circuit technology and said filter of said leveling module is a lumped element absorptive filter.

* * * * *